US009951612B2

(12) United States Patent
Brown-Kerr et al.

(10) Patent No.: US 9,951,612 B2
(45) Date of Patent: Apr. 24, 2018

(54) WELL CONSTRUCTION REAL-TIME TELEMETRY SYSTEM

(71) Applicant: Halliburton Energy Services, Inc., Houston, TX (US)

(72) Inventors: William Brown-Kerr, Aboyne (GB); Bruce Hermann Forsyth McGarian, Stonehaven (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 322 days.

(21) Appl. No.: 14/764,666

(22) PCT Filed: Sep. 23, 2014

(86) PCT No.: PCT/US2014/056929
§ 371 (c)(1),
(2) Date: Jul. 30, 2015

(87) PCT Pub. No.: WO2016/048280
PCT Pub. Date: Mar. 31, 2016

(65) Prior Publication Data

US 2016/0265350 A1 Sep. 15, 2016

(51) Int. Cl.
*E21B 47/18* (2012.01)
*E21B 34/06* (2006.01)
(Continued)

(52) U.S. Cl.
CPC ..... *E21B 47/18* (2013.01); *E21B 34/06* (2013.01); *E21B 47/185* (2013.01);
(Continued)

(58) Field of Classification Search
CPC ..... E21B 47/18; E21B 34/06; E21B 47/185; E21B 47/187; E21B 47/022; E21B 47/06;
(Continued)

(56) References Cited

U.S. PATENT DOCUMENTS 4,771,408 A 9/1988 Kotlyar
4,839,870 A 6/1989 Scherbatskoy
(Continued)

FOREIGN PATENT DOCUMENTS

EA 008325 B1 4/2007
RU 2260676 C2 9/2005
WO 2016048280 A1 3/2016

OTHER PUBLICATIONS

International Search Report and Written Opinion for PCT/US2014/056929 dated Jun. 16, 2015.

*Primary Examiner* — Yong-Suk Ro
(74) *Attorney, Agent, or Firm* — McDermott Will & Emery LLP

(57) ABSTRACT

Downhole assemblies including a plurality of tubular members extendable within a wellbore and defining a through bore. A telemetry device is positioned within a wall of one of the plurality of tubular members and has a secondary flow path defined therethrough and a valve element engageable with a valve seat provided at an upper end of the secondary flow path. The secondary flow path extends between an inlet and an outlet, both of which fluidly communicate with the through bore and are defined in the one of the plurality of tubular members. A flow restrictor is located within the through bore and is axially positioned between the inlet and the outlet of the secondary flow path. The valve element is actuatable to control fluid flow through the secondary flow path to selectively generate a fluid pressure pulse.

24 Claims, 3 Drawing Sheets

(51) Int. Cl.

| | |
|---|---|
| *E21B 47/022* | (2012.01) |
| *E21B 47/06* | (2012.01) |
| *E21B 49/00* | (2006.01) |

(52) U.S. Cl.
CPC ..... *E21B 47/187* (2013.01); *E21B 47/022* (2013.01); *E21B 47/06* (2013.01); *E21B 47/065* (2013.01); *E21B 49/00* (2013.01)

(58) Field of Classification Search
CPC ..... E21B 47/065; E21B 49/00; E21B 43/123; E21B 34/10; Y10T 29/49405; Y10T 137/7932; Y10T 137/7856
See application file for complete search history.

(56) References Cited

U.S. PATENT DOCUMENTS

| | | | | |
|---|---|---|---|---|
| 6,568,478 | B2 * | 5/2003 | De Almeida | E21B 43/122 166/169 |
| 2002/0040784 | A1 | 4/2002 | De Almeida | |
| 2011/0011594 | A1 | 1/2011 | Young et al. | |
| 2011/0214498 | A1 | 9/2011 | Rezgui et al. | |
| 2012/0106297 | A1 | 5/2012 | Fraser | |
| 2013/0255370 | A1 | 10/2013 | Roux et al. | |

* cited by examiner

WELL CONSTRUCTION REAL-TIME TELEMETRY SYSTEM

BACKGROUND

The present disclosure is related to wellbore operations and, more particularly, to fluid-based telemetry devices used in wellbore operations to selectively generate fluid pressure pulses.

In the oil and gas industry, drilling a wellbore, preparing the drilled wellbore for production, and subsequent intervention operations in the completed wellbore each involve the use of a wide range of different specialized equipment. For instance, a drilled wellbore is often lined with bore-lining tubing called "casing" that serves a number of functions, including sealing the wellbore and preventing collapse of the drilled rock formations penetrated by the wellbore. Generally, the casing comprises tubular pipe sections that are coupled together end to end to form a casing string. A series of concentric casing strings can extend from a wellhead to desired depths within the wellbore. Liner is a type of casing that comprises tubular pipe sections coupled end to end but does not extend back to the wellhead. Rather, liner is attached and otherwise sealed to the lower-most section of casing in the wellbore.

After the casing or liner is properly located within the wellbore, cement slurry is commonly pumped into the tubing and back out of the wellbore via the annulus defined between the tubing and the wellbore walls. Once the cement sets, the bore-lining tubing is secured within the wellbore for long-term operation.

A wide range of ancillary equipment is used in both running and locating casing within a wellbore. For example, measuring-while-drilling (MWD) tools are sometimes used to measure various wellbore parameters and guide casing strings to target locations within the wellbore. MWD tools are also able to communicate in real-time with a surface location, thereby providing real-time updates to a well operator of the wellbore parameters measured downhole and the current location and orientation of the casing string within the wellbore. Some MWD tools communicate with the surface location using mud-pulse telemetry, which consists of generating fluid pressure pulses that are transmitted to the surface through a column of fluid within the wellbore. Systems exist to generate 'negative' and 'positive' fluid pressure pulses that can be sensed and interpreted at the surface location.

In running casing into a wellbore, the MWD tool is often disposed in a probe positioned within the casing. This leads to inevitable wear and tear on the MWD tool, primarily through the processes of erosion as fluids circulate around and past the probe within the through bore of the casing. The cost of operating MWD equipment is therefore often determined by the required flow rates and types of fluids circulated within the wellbore. Furthermore, as the through bore of the casing is substantially obstructed by the MWD equipment and probe, it is difficult to pass other equipment through the through bore. For instance, actuating devices, such as hydraulic fracturing balls ("frac balls") or other similar downhole equipment, are often conveyed downhole to actuate a sliding sleeve or valves. The MWD equipment and probe, however, may present a considerable obstacle in reaching the sliding sleeves or valves located below the MWD equipment.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to wellbore operations and, more particularly, to fluid-based telemetry devices used in wellbore operations to selectively generate fluid pressure pulses.

The presently disclosed embodiments provide wall-mounted fluid-based telemetry devices, also known as pulser devices, that are able to monitor the deployment of wellbore tubulars while eliminating the need to subsequently mill out the telemetry device. The exemplary wall-mounted telemetry devices may be positioned within an upset portion provided on the wall of a wellbore tubular, which may include casing or drill pipe. As a result, the telemetry devices described herein are not required to be milled or drilled out subsequent to operation, which eliminates the need to mill or drill exotic materials, such as batteries that may power the telemetry devices.

The telemetry devices described herein may also include various sensors and gauges configured to monitor several wellbore parameters including, but not limited to, the inclination and azimuth of the wellbore tubulars, the temperature and pressure in the wellbore environment, and the depth of the wellbore tubulars. Such measured data may be transmitted to the surface in real-time with the telemetry devices using mud-pulse telemetry. Advantageously, the wall-mounted telemetry devices described herein do not require an exit orifice to the annulus defined between the wellbore tubulars and the wellbore wall. Rather, the exemplary telemetry devices discharge fluid back into the main through bore of the assembly. As a result, there are no potential leak paths extending between the through bore and the annulus that might cause future leaks and problems.

Figure 1:
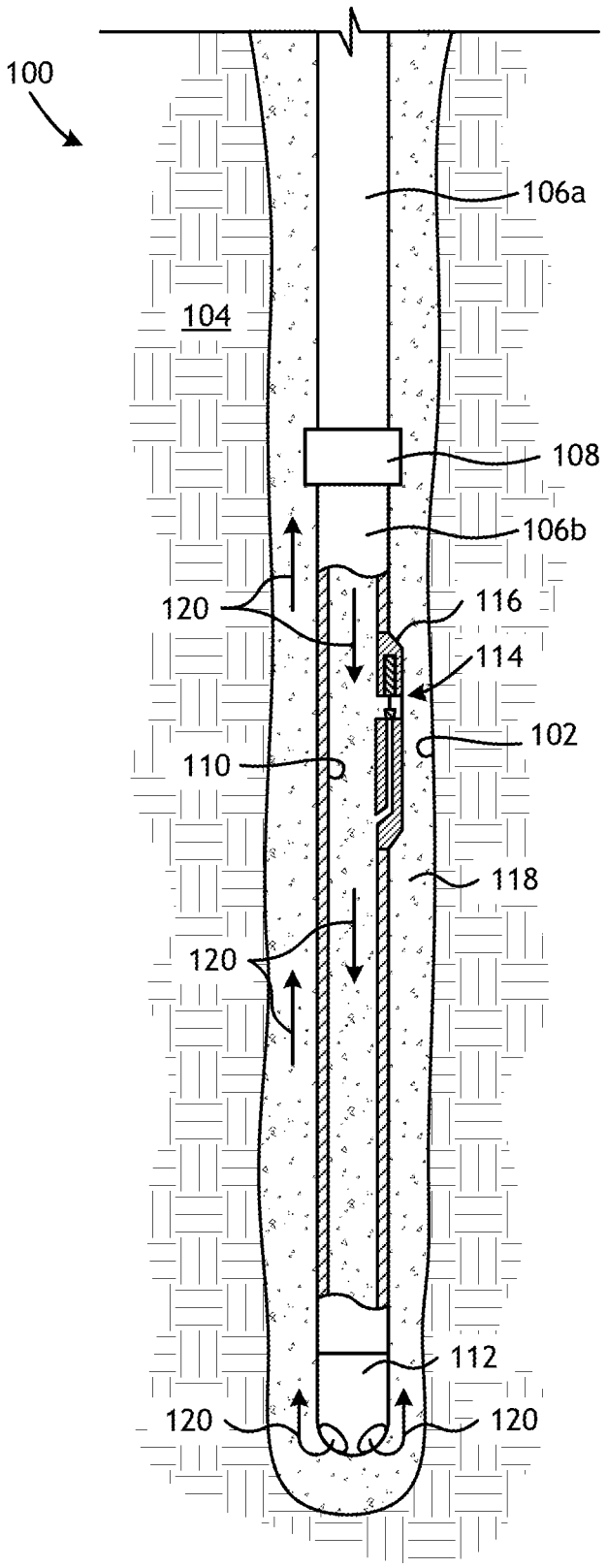
FIG. 1 is a schematic diagram of a downhole assembly that may employ the principles of the present disclosure.

Referring to FIG. 1, illustrated is partial cross-sectional view of a downhole assembly 100 that may employ the principles of the present disclosure, according to one or more embodiments. As illustrated, the downhole assembly 100 may be positioned within a wellbore 102 that penetrates one or more subterranean formations 104. The downhole assembly 100 may include a plurality of tubular members 106 (two shown as first and second tubular members 106*a* and 106*b*, respectively) extendable within the wellbore 102 and coupled at their ends to each other at appropriate coupling locations 108. The tubular members 106*a,b* may provide or otherwise define an inner flow passageway or through bore 110 that is able to receive and convey fluids through the downhole assembly 100. In some embodiments, the through bore 110 extends to a surface location such that fluids introduced into the through bore 110 at the surface are able to reach the downhole assembly 100.

In the illustrated embodiment, the tubular members 106 are depicted as bore-lining pipes or conduits, such as casing or liner. Accordingly, in at least one embodiment, the plurality of tubular members 106 may comprise a string of casing disposed within the wellbore 102, and the downhole assembly 100 may be used to undertake a wellbore completion operation, such as cementing the tubular members 106*a,b* in place within the wellbore 102 or aligning a pre-milled window (not shown) with a high side of the wellbore 102. As illustrated, the second tubular member 106*b* may be the last tubular member 106 in the string of casing as extended into the wellbore 102. A casing shoe 112 may be coupled to the distal end of the second tubular member 106*b*.

It should be noted that while the downhole assembly 100 is illustrated and generally described herein with respect to tubular members 106 that may comprise casing or liner, the principles of the present disclosure are equally applicable to downhole assemblies that use other types of downhole pipes or conduits. In other embodiments, for instance, the plurality of tubular members 106 may include, but are not limited to, drill pipe and production tubing. Accordingly, in at least one embodiment, the downhole assembly 100 may be used during a drilling operation, such as drilling the wellbore 102. In such embodiments, the casing shoe 112 may be replaced with a drill bit (not shown) or the like, without departing from the scope of the disclosure.

The downhole assembly 100 may further include a fluid-based telemetry device 114 coupled or otherwise attached to a wall of one of the tubular members 106*a,b*. More particularly, the fluid-based telemetry device 114 (hereafter "the telemetry device 114") may be disposed within or inside the wall of the second tubular member 106*b* such that the through bore 110 of the second tubular member 106*b* is unobstructed by the telemetry device 114. In the illustrated embodiment, the telemetry device 114 is depicted as being positioned within or inside an upset portion 116 defined or otherwise provided on the wall of the second tubular member 106*b*. The upset portion 116 may form an integral part of the wall of the second tubular member 106 and otherwise extend radially outward therefrom and into the annulus 118 defined between the tubular members 106 and the wellbore 102 wall. In other embodiments, however, the wall of the second tubular member 106*b* may be sufficiently thick to house the telemetry device 114 without requiring radial expansion of its outer diameter.

The telemetry device 114 may be used for measuring one or more wellbore parameters within the wellbore 102, and generating fluid pressure pulses to transmit data relating to the measured wellbore parameters to a surface location (not shown). In exemplary operation, a fluid 120 may be circulated through the downhole assembly 100 and, more particularly, into the tubular members 106*a,b* and past the telemetry device 114. The fluid 120 may exit the tubular members 106*a,b* via the casing shoe 112 and proceed back uphole toward the surface via the annulus 118. In some embodiments, the fluid 120 may be drilling fluid or "mud" used to help move the downhole assembly 100 to a target location within the wellbore 102. In other embodiments, the fluid 120 may be a cement used to secure the tubular members 106*a,b* within the wellbore 102 once a target location within the wellbore 102 is reached.

The telemetry device 114 may be configured to continuously or intermittently monitor various wellbore parameters, such as the depth, azimuth, inclination, and tool-face direction of the downhole assembly 100. Using mud-pulse telemetry, the telemetry device 114 may further be configured to transmit the measured wellbore parameters in real-time to the surface location for consideration by a well operator. Conventional wall-mounted pulsers often discharge fluids into the annulus 118, which provides a flow path to the annulus 118 and therefore represents a potential leak path into the through bore 110. In some cases, such flow paths to the annulus 118 in conventional wall-mounted pulsers become plugged with filter cake or other debris derived from the wellbore 102, and thereby frustrates the operation of such wall-mounted pulsers. The telemetry device 114 described herein, however, discharges the fluid 120 back into the through bore 110, thereby eliminating the possibility of a leak path to the annulus 118 and ensuring well integrity.

In embodiments where the tubular members 106*a,b* comprise casing, the telemetry device 114 may prove advantageous in measuring the depth, inclination, and tool-face direction of the tubular members 106*a,b*, and thereby help a well operator locate a position of the downhole assembly 100 relative to a high side of a the wellbore 102. In such embodiments, the downhole assembly 100 may include and otherwise be used to orient a pre-milled window (not shown), for example, with the high side of the wellbore 102. Moreover, in such embodiments, the telemetry device 114 may be positioned as close as possible to the casing shoe 112 so as to be in an optimal position for monitoring the placement of the tubular members 106*a,b* within the wellbore 102.

Figure 2A:
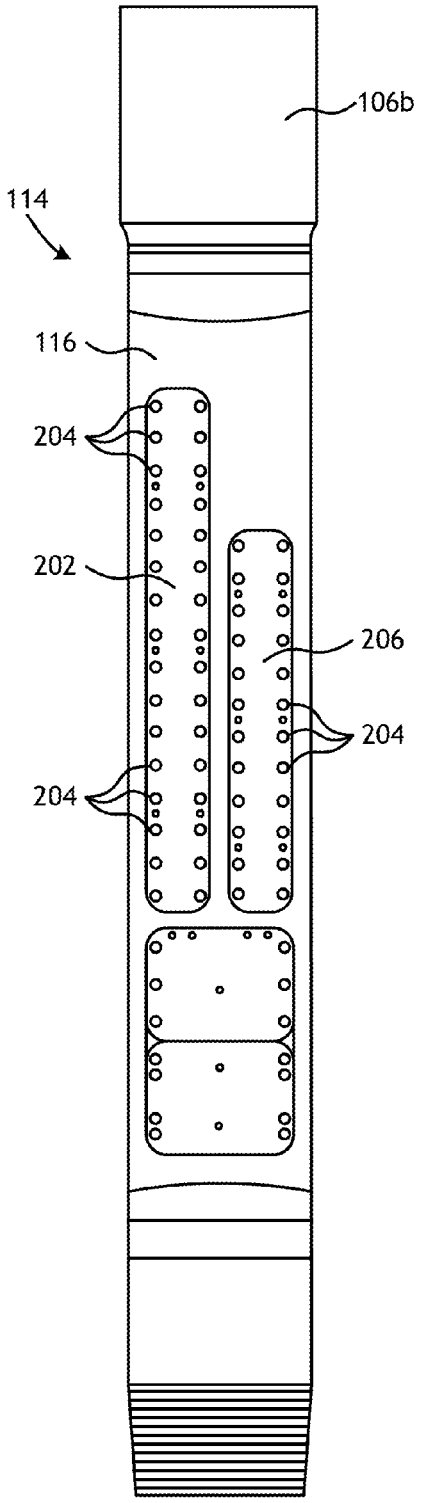
FIGS. 2A and 2B are enlarged side views of the exemplary telemetry device of FIG. 1.
Figure 2B:
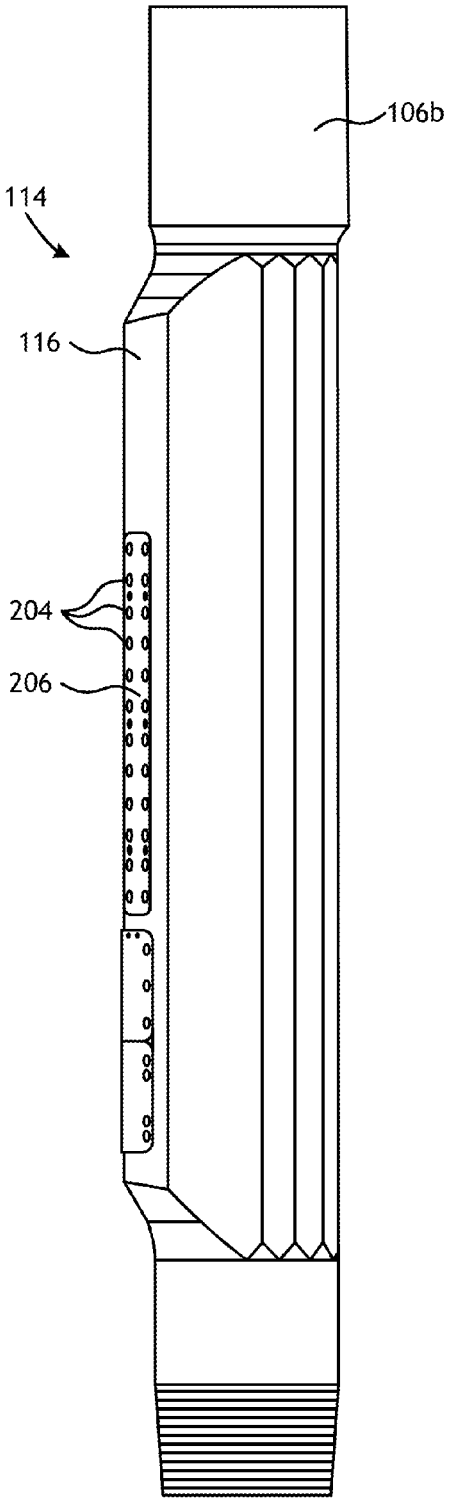

Referring now to FIGS. 2A and 2B, with continued reference to FIG. 1, illustrated are enlarged side views of the telemetry device 114, according to one or more embodiments. As illustrated, the telemetry device 114 may be arranged within a cartridge 202 (not shown in FIG. 2B) mounted on or otherwise within the upset portion 116 of the second tubular member 106*b*. In some embodiments, the cartridge 202 may be mechanically fastened to the upset portion 116, such as by a plurality of bolts 204. In other embodiments, the cartridge 202 may be secured to the upset portion 116 by other means including, but not limited to, welding, snap rings, an interference fit, adhesives, and any combination thereof. The cartridge 202 may house some or all of the components of the telemetry device 114, such as the electronics, sensors, and gauges used to operate the telemetry device 114.

In some embodiments, the telemetry device 114 may further include a power cartridge 206 that may also be mounted on or otherwise within the upset portion 116 and secured thereto with bolts 204. As illustrated, the power cartridge 206 may be laterally offset from the cartridge 202 and otherwise angularly adjacent the cartridge 202 about the outer radial surface of the upset portion 116. The power cartridge 206 may house a power source used to provide electrical power to the telemetry device 114. In some embodiments, for example, the power cartridge 206 may have one or more batteries arranged therein. In other embodiments, however, the power cartridge 206 may be omitted and the power source that powers the telemetry device 114 may be arranged within the cartridge 202, without departing from the scope of the disclosure.

Figure 3A:
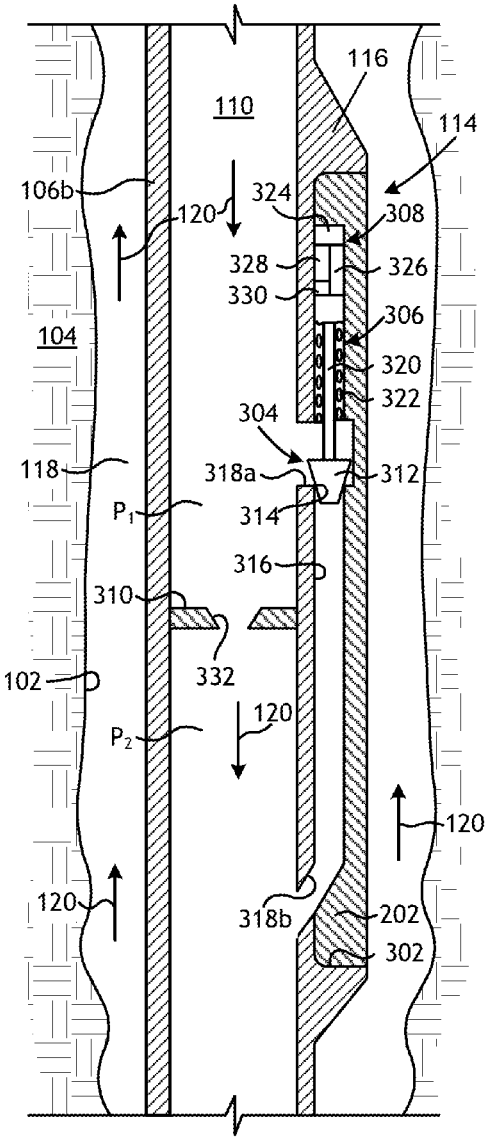
FIGS. 3A and 3B are enlarged cross-sectional side views of the exemplary telemetry device of FIG. 1 in closed and open positions, respectively.
Figure 3B:
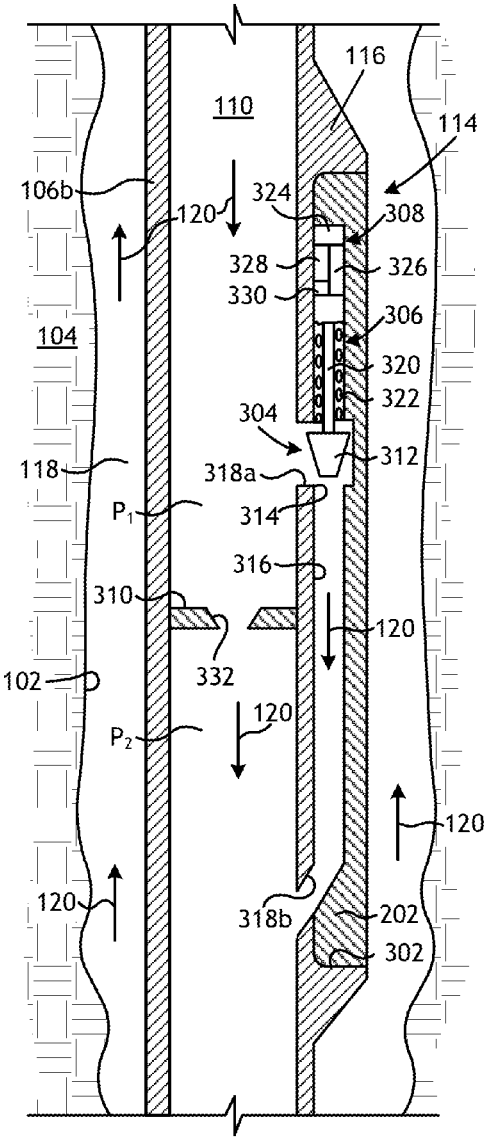

Referring now to FIGS. 3A and 3B, illustrated are enlarged cross-sectional side views of the telemetry device 114, according to one or more embodiments. More particularly, FIG. 3A depicts the telemetry device 114 in a closed position, and FIG. 3B depicts the telemetry device 114 in an open position. As illustrated, the telemetry device 114 is arranged within the wellbore 102 adjacent the subterranean formation 104. Moreover, the telemetry device 114 is depicted as being positioned or otherwise arranged within or inside a cavity 302 defined within the wall (e.g., the upset portion 116) of the tubular member 106*b* such that the through bore 110 of the tubular member 106*b* remains unobstructed by the telemetry device 114. As illustrated, the telemetry device 114 is arranged within the cartridge 202, which may be releasably mounted within the cavity 302 defined in the upset portion 116.

The telemetry device 114 may include an operating valve 304, an actuator 306 coupled to the operating valve 304, a control system 308 used to control the actuator 306, and a flow restrictor 310 located within the through bore 110 of the tubular member 106*b*. The operating valve 304 may include a valve element 312 configured to seal against a valve seat 314 provided at an upstream or "upper end" of a secondary flow path 316 defined in the telemetry device 114. In some embodiments, the operating valve 304 may be generally characterized as a poppet valve. The secondary flow path 316 may extend between an inlet 318*a* and an outlet 318*b*, both being defined in the tubular member 106*b* and configured to allow fluid communication between through bore 110 and the secondary flow path 316. In some embodiments, the secondary flow path 316 may be defined in or through a portion of the upset portion 116. In other embodiments, the internal flow path may be defined in or through a portion of the cartridge 202. In yet other embodiments, the secondary flow path 316 may be defined in or through a combination of the upset portion 116 and the cartridge 202.

As described in more detail below, the telemetry device 114 may be actuatable to selectively move the valve element 312 in and out of sealing abutment or engagement with the valve seat 314 and thereby generate fluid pressure pulses that may be detectable at a surface location. Moving the valve element 312 may be accomplished by activating the actuator 306, which may include a shaft 320 coupled to the valve element 312. In some embodiments, the actuator 306 may be a solenoid-type actuator. In other embodiments, the actuator 306 may be any other type of actuator including, but not limited to, a mechanical actuator, an electrical actuator, an electromechanical actuator, a hydraulic actuator, a pneumatic actuator, and any other device or apparatus that may be able to move the valve element 312 in and out of engagement with the valve seat 314. In the illustrated embodiment, a return spring 322 may be provided to bias the valve element 312 into sealing abutment with the valve seat 314. Accordingly, the default position of the valve element 312 may be in engagement with the valve seat 314.

The control system 308 may be configured to control operation of the actuator 306 and, therefore, the operating valve 304. In some embodiments, the control system 308 may further include a power source 324 that provides power for operating the actuator 306 and the control system 308. In some embodiments, the power source 324 may include a conventional battery pack. In other embodiments, the power source 324 may be omitted from the control system 308, and instead form part of the power cartridge 206, as described above with reference to FIGS. 2A-2B.

In some embodiments, the control system 308 may further include various sensors 326 and a microprocessor 328. The sensors 326 may include orientation, geological, and/or physical sensors used to measure certain wellbore parameters. Suitable orientation sensor(s) may include, but are not limited to, an inclinometer, a magnetometer, and a gyroscopic sensor. Suitable geological sensor(s) may include, but are not limited to, a gamma sensor, a resistivity sensor, and a density sensor. Suitable physical sensor(s) may include, but are not limited to, sensors for measuring temperature, pressure, acceleration, and strain parameters.

The microprocessor 328 may include a memory 330 and comprise stacked circular or rectangular printed circuit boards. The memory 330 may be configured to store data and programming instructions executable by the microprocessor 328 to operate the telemetry device 114. In some embodiments, the data obtained by the sensors 326 may be stored in the memory 330. In other embodiments, as described below, the data obtained by the sensors 326 may be processed by the microprocessor 328 and encoded into a series of decipherable fluid pressure pulses generated by the telemetry device 114. Such pressure pulses may be transmitted uphole to a surface location for decoding and consideration by a well operator.

The flow restrictor 310 may be located in the through bore 110 axially between the inlet 318*a* and the outlet 318*b* of the secondary flow path 316. More particularly, the flow restrictor 310 may be positioned such that the inlet 318*a* is upstream or uphole of the restriction and the outlet 318*b* is downstream or downhole from the flow restrictor 310. The flow restrictor 310 may be configured to restrict fluid flow and, more particularly, may be configured to restrict fluid flow through the through bore 110. As a result, a pressure drop or differential may be assumed across the flow restrictor 310 such that fluid pressure $P_1$ above the flow restrictor 310 may be greater than fluid pressure $P_2$ below the flow restrictor. Such a pressure drop between $P_1$ and $P_2$ may be required to properly operate the telemetry device 114, as described below.

In some embodiments, the flow restrictor 310 may be made of or otherwise comprise a material that does not require a significant amount of time to mill or drill through and otherwise generates a low amount of cuttings debris. Suitable materials for the flow restrictor 310 include, but are not limited to, aluminum, bronze, a composite material, any combination thereof, and the like. In such embodiments, debris management may no longer present a significant issue, since no steel cuttings are generated in removing the flow restrictor 310 and, therefore, lengthy milling and cleanout trips are substantially eliminated.

Following final operations of the telemetry device 114, the flow restrictor 310 may be removed from the through bore 110 by milling or drilling through the flow restrictor 310 with a mill or drill bit (not shown) extended into the tubular member 106*b*. With the flow restrictor 310 removed, the through bore 110 may be unobstructed for fluid flow at that location. In some embodiments, the flow restrictor 310 may include or otherwise define a nozzle 332 that generates the required pressure drop across the flow restrictor 310. In other embodiments, the flow restrictor 310 may comprise a burst disk with a central hole defined therethrough that allows a metered or predetermined amount of fluid flow. As described below, the burst disk may be configured to break or otherwise fail upon assuming a predetermined axial load or fluid pressure.

Exemplary operation of the telemetry device 114 is now provided. A fluid may be conveyed into and through the through bore 110, as indicated by the arrows 120. As mentioned above, the fluid 120 may be a drilling fluid or a cement used for various wellbore operations. The fluid 120 may be circulated into the tubular members 106*a,b*, past the telemetry device 114, and proceed back uphole toward the surface via the annulus 118. When the fluid 120 enters the through bore 110, the fluid 120 flows through the flow restrictor 310, which causes the pressure $P_1$ to be greater than the pressure $P_2$ due to the pressure loss assumed across the flow restrictor 310.

As indicated above, the default position of the operating valve 304 may be the closed position, where the valve element 312 is in sealing abutment with the valve seat 314. With the operating valve 304 in the closed position, fluid flow along the secondary flow path 316 is substantially prevented. To generate a fluid pressure pulse, a signal may be sent by the microprocessor 328 to the actuator 306, which results in axial translation of the shaft 320 and corresponding movement of the valve element 312 out of sealing abutment with the valve seat 314. This places the telemetry device 114 in the open position, as shown in FIG. 3B, and otherwise opens the secondary flow path 316 to allow a portion of the fluid 120 to enter the secondary flow path 316 via the inlet 318*a*. The fluid 120 that flows through the secondary flow path 316 is eventually discharged back into the through bore 110 axially below the flow restrictor 310. Accordingly, unlike conventional wall-mounted telemetry devices, the telemetry device 114 does not include a potential leak path extending between the through bore 110 and the annulus 118 that might cause future leaks or problems.

Opening the secondary flow path 316 effectively increases the flow area of the telemetry device 114. Consequently, the pressure $P_1$ of the fluid 120 above the flow restrictor 310 and upstream of the inlet 318*a* is reduced so that a negative pressure pulse is generated within the through bore 110, which may be communicated up the through bore 110 and detected at the surface. After a desired period of time, the actuator 306 may be deactivated and the return spring 322 will urge the valve element 312 back into sealing abutment with the valve seat 314, thereby closing the secondary flow path 316 once again. Closing the secondary flow path 316 reduces the flow area of the telemetry device 114 and simultaneously raises the pressure $P_1$ of the fluid 120 upstream of the flow restrictor 310. Again, this pressure change may be detected at the surface. The operating valve 304 may be operated several times to move between closed and open positions and thereby generate a string of fluid pressure pulses that are detectable at the surface. In a known fashion, data relating to wellbore parameters measured by the sensors 326 can be transmitted to the surface by operating the telemetry device 114 as described herein.

In some embodiments, positive fluid pressure pulses may be generated with the telemetry device 114. This may be achieved by normally holding the valve element 312 out of sealing abutment with the valve seat 314 (or by holding the valve element 312 out of abutment for a certain period of time), such that the secondary flow path 316 is open. In some embodiments, this may be accomplished by replacing the return string 322 with a tension spring (not shown) that urges the valve element 312 away from the valve seat 314. Operation of the actuator 306 may then act against the force of the tension spring to urge the valve element 312 into sealing abutment with the valve seat 314. Repeatedly closing the operating valve 304 thus closes the secondary flow path 316 to generate positive pressure pulses within the through bore 110. Alternatively, the actuator 306 may be maintained in an activated state to hold the valve element 312 clear of the valve seat 314. However, this will use additional electrical energy and, therefore, may be undesirable.

Once a desired wellbore operation has been undertaken or accomplished, such as orienting a pre-milled window defined in one of the tubular members 106*a,b* (FIG. 1) relative to a high side of the wellbore 102, the telemetry device 114 may no longer be needed. At that time, the flow restrictor 310 may be removed from the through bore 110 to eliminate fluid flow obstructions at that location within the through bore 110. In some embodiments, as mentioned above, this may be accomplished by extending a mill or drill bit (not shown) into the through bore and drilling out the flow restrictor 310. In other embodiments, a wellbore projectile, such as a cement plug, wellbore dart, or ball, may be introduced into the through bore 110 and flowed to the flow restrictor 310. In some embodiments, the wellbore projectile may locate and break the flow restrictor 310. In other embodiments, the wellbore projectile may land on the flow restrictor 310 and the pressure $P_1$ in the through bore 110 may be increased to place an axial load on the flow restrictor 310 until the flow restrictor 310 fails. In yet other embodiments, the flow restrictor 310 may comprise a burst disk configured to fail upon assuming a predetermined axial load applied from a wellbore projectile or through an increase in the pressure $P_1$ to a predetermined fluid pressure. With the flow restrictor 310 removed, the through bore 110 may be unobstructed for fluid flow at that location, and thereby provide a larger flow area that permits enhanced flow cementing operations to take place.

The structural location of the telemetry device 114 in the wall of the tubular member 106*b* and otherwise in the upset portion 116 may provide advantages over conventional telemetry devices. Specifically, generation of fluid pressure pulses in the telemetry device 114 may be achieved without restricting the through bore 110. Accordingly, the fluid 120 may continue to flow through the through bore 110 and the secondary flow path 316 without restriction due to actuation of the telemetry device 114. Additionally, other downhole tools (not shown) may be conveyed past the telemetry device 114 within the through bore 110, without the telemetry device 114 causing an obstruction. For example, many types of valves and sleeves exist which are actuated by a wellbore projectile, such as a ball or a dart that is introduced into the through bore 110 at the surface. The wellbore projectile may be able to traverse the through bore 110 without being obstructed by the telemetry device 114. The wellbore projectile may then pass on to the valve or sleeve where a suitable catcher receives the wellbore projectile and a build-up of fluid pressure behind (i.e., upstream of) the wellbore projectile actuates the valve or sleeve. Some conventional telemetry devices are positioned within the through bore 110 and are required to be drilled or milled out. Drilling or milling out a telemetry device, however, may result in environmental concerns as it is required to drill through exotic materials and batteries associated with the telemetry device. The telemetry device 114 described herein, however, remains out of the through bore 110 and, therefore, is not required to be milled out subsequent to its operation.

Embodiments disclosed herein include:

A. A downhole assembly that includes a plurality of tubular members extendable within a wellbore and defining a through bore for conveying a fluid therein, a telemetry device positioned within a wall of one of the plurality of tubular members, the telemetry device having a secondary flow path defined therethrough and a valve element engageable with a valve seat provided at an upper end of the secondary flow path, wherein the secondary flow path extends between an inlet and an outlet, both of which fluidly communicate with the through bore and are defined in the one of the plurality of tubular members, and a flow restrictor located within the through bore and being axially positioned between the inlet and the outlet of the secondary flow path, wherein the valve element is actuatable to control fluid flow through the secondary flow path to selectively generate a fluid pressure pulse.

B. A fluid-based telemetry device that includes a cartridge removably mounted to a wall of a tubular member that defines a through bore, a secondary flow path defined through at least one of the cartridge and the tubular member and extending between an inlet and an outlet, both of which fluidly communicate with the through bore and are defined in the tubular member, a valve element arranged within the cartridge and engageable with a valve seat provided at an upper end of the secondary flow path, wherein the valve element is actuatable to control fluid flow through the secondary flow path to selectively generate a fluid pressure pulse, and a flow restrictor located within the through bore and axially positioned between the inlet and the outlet of the secondary flow path.

C. A method that includes introducing a downhole assembly into a wellbore, the downhole assembly including a plurality of tubular members that define a through bore and a telemetry device positioned within a wall of one of the plurality of tubular members, conveying a fluid through the through bore and past the telemetry device, the telemetry device providing a secondary flow path that extends between an inlet and an outlet, both of which fluidly communicate with the through bore and are defined in the one of the plurality of tubular members, the telemetry device further including a valve element engageable with a valve seat provided at an upper end of the secondary flow path, generating a pressure drop within the through bore with a flow restrictor axially positioned within the through bore between the inlet and the outlet of the secondary flow path, and actuating the valve element to control fluid flow through the secondary flow path and thereby selectively generating a fluid pressure pulse.

Each of embodiments A, B, and C may have one or more of the following additional elements in any combination: Element 1: wherein the plurality of tubular members is selected from the group consisting of casing, liner, drill pipe, and production tubing. Element 2: wherein the fluid is at least one of a drilling fluid and a cement. Element 3: wherein the through bore of the one of the plurality of tubular members is unobstructed by the telemetry device. Element 4: wherein the telemetry device is positioned within an upset of the one of the plurality of tubular members. Element 5: wherein the telemetry device is arranged within a cartridge removably mounted to the upset. Element 6: further comprising an actuator operatively coupled to the valve element, and a control system that controls movement of the actuator, and thereby controls actuation of the valve element. Element 7: wherein the control system comprises one or more sensors selected from the group consisting of an orientation sensor, a geological sensor, and a physical sensor. Element 8: wherein the flow restrictor comprises a material selected from the group consisting of aluminum, bronze, a composite, and any combination thereof. Element 9: wherein the flow restrictor comprises a burst disk.

Element 10: wherein the cartridge is positioned within an upset provided on the wall of the tubular member. Element 11: wherein the through bore is unobstructed by the valve element and the secondary flow path. Element 12: further comprising an actuator arranged within the cartridge and operatively coupled to the valve element, and a control system arranged within the cartridge to control movement of the actuator and thereby control actuation of the valve element. Element 13: wherein the control system comprises a sensor selected from the group consisting of an inclinometer, a magnetometer, a gyroscopic sensor, a gamma sensor, a resistivity sensor, a density sensor, a temperature sensor, a pressure sensor, an acceleration sensor, and a strain sensor.

Element 14: wherein conveying the fluid through the through bore and past the telemetry device comprises conveying the fluid through the through bore unobstructed by the telemetry device. Element 15: wherein actuating the valve element comprises moving the valve element with an actuator operatively coupled to the valve element, and controlling movement of the actuator with a control system. Element 16: further comprising obtaining measurement data of one or more wellbore parameters with one or more sensors included in the telemetry device, the one or more sensors being selected from the group consisting of an orientation sensor, a geological sensor, and a physical sensor, actuating the valve element to generate fluid pressure pulses corresponding to the measurement data, and receiving the fluid pressure pulses at a surface location. Element 17: further comprising aligning a pre-milled window defined in the plurality of tubular members with a high side of the wellbore based on the measurement data obtained by the one or more sensors. Element 18: wherein actuating the valve element to control fluid flow through the secondary flow path comprises moving the valve element to an open position and thereby allowing a portion of the fluid from the through bore to enter the secondary flow path via the inlet, and discharging the portion of the fluid back into the through bore via the outlet. Element 19: further comprising removing the flow restrictor from the through bore. Element 20: wherein removing the flow restrictor from the through bore comprises milling out the flow restrictor with a mill or drill bit extended into the through bore, the flow restrictor comprising a material selected from the group consisting of aluminum, bronze, a composite, and any combination thereof. Element 21: wherein removing the flow restrictor from the through bore comprises introducing a wellbore isolation device into the through bore, landing the wellbore isolation device on the flow restrictor, and breaking the flow restrictor with the wellbore isolation device. Element 22: wherein the flow restrictor is a burst disk and removing the flow restrictor from the through bore comprises increasing a fluid pressure within the through bore to a predetermined fluid pressure, and breaking the burst disk upon assuming the predetermined fluid pressure.

By way of non-limiting example, exemplary combinations applicable to A, B, C include: Element 4 with Element 5; Element 6 with Element 7; Element 16 with Element 17; Element 19 with Element 20; Element 19 with Element 21; and Element 19 with Element 22.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A downhole assembly, comprising:

a plurality of tubular members extendable within a wellbore and defining a through bore for conveying a fluid therein;

a telemetry device positioned within a wall of one of the plurality of tubular members and providing a secondary flow path having an inlet and an outlet, the inlet and the outlet each fluidly connecting the secondary flow path to the through bore, the telemetry device further providing a valve element engageable with a valve seat provided at an upper end of the secondary flow path; and a flow restrictor located within the through bore and being axially positioned between the inlet and the outlet of the secondary flow path, wherein the valve element is actuatable to control fluid flow through the secondary flow path to selectively generate a fluid pressure pulse.

2. The downhole assembly of claim 1, wherein the plurality of tubular members is selected from the group consisting of casing, liner, drill pipe, and production tubing.

3. The downhole assembly of claim 1, wherein the fluid is selected from the group consisting of a drilling fluid, a cement, and combination thereof.

4. The downhole assembly of claim 1, wherein the through bore of the one of the plurality of tubular members is unobstructed by the telemetry device.

5. The downhole assembly of claim 1, wherein the telemetry device is positioned within an upset portion of the one of the plurality of tubular members.

6. The downhole assembly of claim 5, wherein the telemetry device is arranged within a cartridge removably mounted to the upset portion.

7. The downhole assembly of claim 1, further comprising:

an actuator operatively coupled to the valve element; and a control system that controls movement of the actuator, and thereby controls actuation of the valve element.

8. The downhole assembly of claim 7, wherein the control system comprises one or more sensors selected from the group consisting of an orientation sensor, a geological sensor, and a physical sensor.

9. The downhole assembly of claim 1, wherein the flow restrictor comprises a material selected from the group consisting of aluminum, bronze, a composite, and any combination thereof.

10. The downhole assembly of claim 1, wherein the flow restrictor comprises a burst disk.

11. A fluid-based telemetry device, comprising:

a cartridge removably mounted to a wall of a tubular member that defines a through bore;

a secondary flow path defined through at least one of the cartridge and the tubular member and extending between an inlet fluidly connecting a first end of the secondary flow path to the through bore and an outlet fluidly connecting a second end of the secondary flow path to the through bore;

a valve element arranged within the cartridge and engageable with a valve seat provided at an upper end of the secondary flow path, wherein the valve element is actuatable to control fluid flow through the secondary flow path to selectively generate a fluid pressure pulse; and a flow restrictor located within the through bore and axially positioned between the inlet and the outlet of the secondary flow path.

12. The fluid-based telemetry device of claim 11, wherein the cartridge is positioned within an upset portion provided on the wall of the tubular member.

13. The fluid-based telemetry device of claim 11, wherein the through bore is unobstructed by the valve element and the secondary flow path.

14. The fluid-based telemetry device of claim 11, further comprising:

an actuator arranged within the cartridge and operatively coupled to the valve element; and a control system arranged within the cartridge to control movement of the actuator and thereby control actuation of the valve element.

15. The fluid-based telemetry device of claim 14, wherein the control system comprises a sensor selected from the group consisting of an inclinometer, a magnetometer, a gyroscopic sensor, a gamma sensor, a resistivity sensor, a density sensor, a temperature sensor, a pressure sensor, an acceleration sensor, and a strain sensor.

16. A method, comprising:

introducing a downhole assembly into a wellbore, the downhole assembly including a plurality of tubular members that define a through bore and a telemetry device positioned within a wall of one of the plurality of tubular members;

conveying a fluid through the through bore and past the telemetry device, the telemetry device providing a secondary flow path having an inlet and an outlet, the inlet and the outlet each fluidly connecting the through bore to the secondary flow path, the telemetry device further including a valve element engageable with a valve seat provided at an upper end of the secondary flow path;

generating a pressure drop within the through bore with a flow restrictor axially positioned within the through bore between the inlet and the outlet of the secondary flow path; and actuating the valve element to control fluid flow through the secondary flow path and thereby selectively generating a fluid pressure pulse.

17. The method of claim 16, wherein conveying the fluid through the through bore and past the telemetry device comprises conveying the fluid through the through bore unobstructed by the telemetry device.

18. The method of claim 16, wherein actuating the valve element comprises:

moving the valve element with an actuator operatively coupled to the valve element; and controlling movement of the actuator with a control system.

19. The method of claim 16, further comprising:

obtaining measurement data of one or more wellbore parameters with one or more sensors included in the telemetry device, the one or more sensors being selected from the group consisting of an orientation sensor, a geological sensor, and a physical sensor;

actuating the valve element to generate fluid pressure pulses corresponding to the measurement data; and receiving the fluid pressure pulses at a surface location.

20. The method of claim 19, further comprising aligning a pre-milled window defined in the plurality of tubular members with a high side of the wellbore based on the measurement data obtained by the one or more sensors.

21. The method of claim 16, wherein actuating the valve element to control fluid flow through the secondary flow path comprises:

moving the valve element to an open position and thereby allowing a portion of the fluid from the through bore to enter the secondary flow path via the inlet; and discharging the portion of the fluid back into the through bore via the outlet.

22. The method of claim 16, further comprising removing the flow restrictor from the through bore.

23. The method of claim 22, wherein removing the flow restrictor from the through bore comprises milling out the flow restrictor with a mill or drill bit extended into the through bore, the flow restrictor comprising a material selected from the group consisting of aluminum, bronze, a composite, and any combination thereof.

24. The method of claim 22, wherein the flow restrictor is a burst disk and removing the flow restrictor from the through bore comprises:

increasing a fluid pressure within the through bore to a predetermined fluid pressure; and breaking the burst disk upon assuming the predetermined fluid pressure.

* * * * *